US005444813A

United States Patent [19]

Stehling et al.

[11] Patent Number: 5,444,813

[45] Date of Patent: Aug. 22, 1995

[54] INFRARED LAMP MOUNTING ARRANGEMENT USING SPACED MOUNTING HOLES ENABLING DESIRED POSITIONING THEREOF

[75] Inventors: Ronald Stehling, Alzenau; Karl Schülke, Grosskrotzenburg, both of Germany

[73] Assignee: Heraeus Noblelight GmbH, Hanau, Germany

[21] Appl. No.: 40,404

[22] Filed: Mar. 31, 1993

[30] Foreign Application Priority Data

Mar. 31, 1992 [DE] Germany ..... 42 10 519.6

[51] Int. Cl.[6] ..... H05B 3/06

[52] U.S. Cl. ..... 392/407; 392/412; 219/541; 362/285; 362/457; 362/226

[58] Field of Search ..... 392/407, 411, 412; 219/541; 362/250, 285, 457, 368, 220, 225, 226, 249

[56] References Cited

U.S. PATENT DOCUMENTS

| | | | |
|---|---|---|---|
| 3,005,081 | 10/1961 | Kordes et al. | 219/541 |
| 3,218,446 | 11/1965 | Langer | 362/285 |
| 3,231,846 | 1/1966 | Radke | 219/541 |
| 3,401,369 | 9/1968 | Palmateer et al. | 219/541 |
| 3,527,933 | 9/1970 | Thummel | 362/226 |
| 4,531,047 | 7/1985 | Canfield et al. | 392/407 |
| 4,532,579 | 7/1985 | Merryman | 362/285 |
| 5,142,609 | 8/1992 | Hilscher et al. | 392/407 |
| 5,310,355 | 5/1994 | Dannatt | 362/249 |

FOREIGN PATENT DOCUMENTS

| | | |
|---|---|---|
| 0465766A | 1/1992 | European Pat. Off. . |
| 2181568 | 12/1973 | France . |
| 1490752 | 7/1969 | Germany . |
| 3619919 | 1/1988 | Germany . |

OTHER PUBLICATIONS

Heraeus Quarzschmelze GmbH, Infrarot Division brochure "Mittelwellige Bausatz-Infrarotstrahler MBS", (Medium-wavelength Modular Infra-red irradiator MBS) published Apr. 1988, Kleinostheim, West Germany, pp. 1-6.

*Primary Examiner*—Bruce A. Reynolds
*Assistant Examiner*—John A. Jeffery
*Attorney, Agent, or Firm*—Frishauf, Holtz, Goodman & Woodward

[57] ABSTRACT

In order to simplify mounting and rearrangement of the infra-red lamps, and to minimize the size of unheated zones, an assembly plate (1) is formed with a pattern of assembly apertures (3) having at least three-fold symmetry. The bases (2) of the lamps (6) are formed with electrical passages (4) and fastening holes (5) whose spacing is compatible with the assembly aperture pattern. The electrical terminals are formed as contact pins (17) which project perpendicular to the quartz glass tube axis, set back from the ends (8,9) thereof, and make contact with a power supply in the electrical passages (4) in the bases (2). Multiple infra-red lamps (6) can thus be mounted closely adjacent to each other on the assembly plate (1), and the mounting configuration can be changed, e.g. by 90° rotation of a lamp, with minimal rewiring effort. The completed system is suitable for surface heating or drying of products passing by on a conveyor belt or other production line.

18 Claims, 2 Drawing Sheets

INFRARED LAMP MOUNTING ARRANGEMENT USING SPACED MOUNTING HOLES ENABLING DESIRED POSITIONING THEREOF

FIELD OF THE INVENTION

The present invention relates generally to infra-red lamp irradiation systems and, more particularly, to an improved modular system having an assembly plate and many lamps mounted on the plate by means of plug-in bases. Each lamp has an open-ended quartz glass tube, in which a heating coil with two electrical terminals runs, and a pair of ceramic closure caps, each supported by one of the bases. At least one of the two bases supporting each lamp is formed with an electrical passage running normal to the plane of the assembly plate, and in which insulated electrical connections to the heating coil are made.

Such irradiation units are used, either as individual irradiators, or as individual elements of infra-red surface irradiators, for warming, drying, and/or curing of large-surface area products or of a plurality of products passing by the surface irradiator. For example, one may need to dry paint quickly in vehicle production, or to cure plastic coatings rapidly. Typical output is 15–35 kilowatts per sq. meter.

BACKGROUND

The brochure of Heraeus Quarzschmelze GmbH entitled "INFRAROT, mittelwellige Bausatz-Infrarotstrahler MBS" [INFRARED, medium-wavelength modular set—Infrared lamp MBS] bearing printer's legend 1C 4.88/VN Ku, discloses lamp units in which the infra-red lamps are in the form of so-called "twin tubes" open at the ends, with the ends being surrounded by wrap-around holding bases, in turn secured to a mounting surface.

Each holding base is in the form of an angle-iron, of which one element has a slot running parallel to the element underside, and the upper side of the other element has a longitudinal recess. By means of these, the holding bases are stuck on opposing faces of the assembly sheet, and together with it form a holding frame for the infra-red lamp. The lamp is held between bases, and thus is received by the longitudinal recess of the holding base.

The holding frames are provided with fastening bolts. The holding bases are secured to the sheet by butterfly nuts on the backside of the assembly sheet, and are secured with a high-temperature-resistant spring. For mounting and unmounting of the individual infra-red lamps, the nuts and springs have to be released.

The electrical connections for the heating coils of the individual infra-red lamps are accomplished in the form of two insulated cables at a common end face of the twin tube, the cables are bent 90° to the assembly frame, and fed through two grooves of the holding base, threaded through corresponding holes in the holding frame, and fed to the back side of the assembly frame, where they are finally connected to power supply. In order to swap out or exchange an infra-red lamp, the existing electrical connections must be removed and, when the new infra-red lamp is mounted, new connections must be wired.

On a single assembly frame, multiple parallel infra-red lamps are fastened, with lengths matched to the dimensions of the assembly frame. By modular addition of multiple assembly frames to form a larger unit, one can build surface irradiators whose irradiating surface corresponds to that of the goods to be irradiated. If necessary, the assembly frames can also be arranged perpendicular to each other, so that the longitudinal axes of the infra-red lamps are rotated 90° to each other.

The assembly frames are available in two different standard lengths, matched to the infra-red lamps. The length of the larger assembly frame corresponds to twice the standard breadth, and to twice the standard length, of the smaller assembly frame. With these standard radiating units, it is possible, in the sense of a modular system, to alter the geometry of surface radiators and to adapt them to the goods to be heated, but the least little geometric variation is determined by the dimensions of the smaller assembly frame. For a change in the geometry of a surface irradiator, made of known lamp units, the assembly frame and the infra-red lamps bus be separated, and re-mounted in the desired configuration.

The wall thickness of the holding base, in the direction of the longitudinal axis of the infra-red lamp, is relatively large, first, because a certain insulation is prescribed to prevent flash-over or arcing between adjacent power supply parts, and second, because the bending of the electrical connectors within the holding base cannot go below a minimal radius of curvature, since otherwise the connecting wires would snap off. Thus, the known radiating units form relatively long unheated zones at the end faces of the infra-red lamps, and upon assembly of these irradiating units, the inhomogenous temperature course at these places becomes apparent.

THE INVENTION

Accordingly, it is an object of the present invention to provide a cost-effective and reliably operating irradiating unit which permits simple mounting, unmounting, and variable arrangement of the infra-red lamp units, and which can be assembled to form a surface radiator with the shortest possible unheated zones.

Briefly, this is accomplished by: providing receiving elements in the form of a raster pattern of holes having at least three-fold symmetry, equipping the bases with a fastening hole for insertion of a fastening screw, and with an electrical passage, the interval between these latter two being compatible with the raster pattern on the assembly plate, making closure caps releasibly connected to their associated base elements, and by making electrical connections by means of two contact pins which project at right angles to the longitudinal axis of the quartz glass tube, and connect to a power supply in the electrical passage within the base.

Due to the facts that the assembly plate has receiving elements in the form of assembly apertures in a basic pattern having at least three-fold symmetry, that bases are fastened thereon, that each base has at least one fastening hole and at least one electrical passage or contact hole, the spacing of these being compatible with the raster pattern on the assembly plate, it is possible to rotate the infra-red lamp unit on the assembly plate by a specific angle which is calculated by division of the 360° full circle by the symmetry number of the basic pattern. Upon rotation by this specific angle, or by an integer multiple thereof, the fastening hole and the electrical contact hole coincide with the assembly apertures of the assembly plate. In the event that the base has further assembly elements, all these assembly elements are designed to be compatible with the raster pattern. This fact assures that the infra-red lamp is rotatable by the specific angle, without requiring any special holes in the assembly plate.

The term "compatible" should be understood to mean that, in a specific arrangement of the bases, all assembly elements and electrical contact holes can be aligned with the assembly apertures in the assembly plate. The lamps can be packed closely together to cover the assembly plate. By this form of assembly plate and bases, the arrangement of the infra-red irradiating lamps can be matched, in a simple and flexible manner, to the goods to be heated or to other requirements. Mounting or unmounting of the assembly plate is not necessary.

Clearly, the basic pattern of the assembly apertures can repeat over a large area of the assembly plate, so that translational displacement of the bases, and of the infra-red lamps mounted thereon, is made possible in simple fashion.

The fact that at least one of the assembly elements is in the form of a fastening hole running perpendicular to the plane of the assembly plate, and receives a fastening element which anchors in the assembly plate, means that the fastening element is accessible on the easy-to-reach side of the assembly plate, in contrast to the prior art structure described above.

The facts that the bases have through-holes for guidance of the electrical terminals, and that the position of these holes corresponds to the basic raster pattern on the assembly plate, means that feeding through of the electrical terminals to the back side of the assembly plate, remote from the infra-red lamps, can take place through the regular assembly apertures, and no additional or supplemental holes in the assembly plate are needed. Here, it is possible for the two electrical leads to be insulated from each other and commonly routed through one electrical passage, or fed separately through two electrical passages, either in a single base or in respective bases of the same infra-red lamp.

The facts that the end pieces or closure caps are releasibly connected to their associated bases, that the electrical terminals are fed, in the form of two contact pins, out of at least one end piece, that their free ends extend, perpendicular to the longitudinal axis of the quartz glass tube, to make contact, with a power supply, in the passage within a base, makes it possible to mount or detach the infra-red lamp from the side of the assembly plate facing the products to be heated. One can simply pull off an infra-red lamp along with its end pieces, in a direction perpendicular to its longitudinal axis, without having to detach the associated base element. To make electrical contact between the contact pins and the power supply, metallic contact bodies, e.g. in the form of sleeves or bushings, are provided to contact the contact pins. The contact pins preferably consist of high-temperature-resistant material, due to the high temperatures adjacent the infra-red lamp. As previously noted, the contact pins can either both come out of the same end of the infra-red lamp, or can come out of two respective ends of the lamp, and extend into the electrical passage of the base associated with that end piece.

The implementation of the terminals in the form of contact pins permits making the ceramic end pieces with a thin wall thickness, measured with respect to the longitudinal axis of the lamp, so that, in the example of the placement of two tubes end-to-end, the unheated zone adjacent the ends is relatively short.

It has been found to be particularly advantageous for the assembly apertures to have identical diameters and to be arrayed in a quadratic raster pattern. This permits rotation of a base mounted on the assembly plate by 90° or integer multiple thereof. Such a raster can be continued over the whole assembly plate, so that even translational movement of the base is made possible, the interhole spacing defining the smallest possible translation.

The fact that the apertures are all the same diameter makes manufacture of the assembly plate simple and economical. One can mount the bases without concern as whether a particular hole is to serve for fastening of a screw or for feeding of electrical leads.

It has proven to be advantageous to provide the bases with two holes for insertion of fastening elements such as screws for securing the base onto the assembly plate. This means that the screwheads can be reached from the easily accessible side of the assembly plate. The fastening of the bases using two fastening elements also provides secure attachment, even under conditions that subject the irradiating unit to vibration.

A particularly simple structure is for each base to have two electrical terminal passages which, together with the two fastening holes, are in a pattern compatible with the raster pattern of the assembly plate. When using such bases, it is equally possible for both electrical connections to come out of one ceramic end piece, or for each connection to come out of a respective end piece and to be fed through a respective base. To conserve space and to avoid superfluous assembly apertures, it is desirable for bases to have two fastening holes and two electrical passage holes, arranged in a quadratic pattern.

With the objective of a surface irradiation system with the shortest possible unheated zones, a lamp unit is preferred, in which the bases extend outward, in the direction of the longitudinal axis of the quartz glass tube, no farther than the ceramic closure caps or end pieces of the lamp, and for the contact pins to project at a position set back from the lamp ends. Such a structure assures that, when lamps are arranged end-to-end, the unheated zones, adjacent the junctions, are kept as short as possible, since the bases are not between the lamps. Setting the contact pins back from the tube ends also permits making the walls of the ceramics thinner without increasing the danger of spark-over or arcing. This thinner wall also contributes to keeping the unheated zone size smaller.

A particularly simple and economical structure is a lamp unit, in which the base has four through-bores or holes, of which two adjacent ones serve as electrical contact passages and two other adjacent ones serve as fastening holes.

Another proven feature is for the lamp unit to have end pieces which wrap around the ends of the quartz glass tube, one end piece of which has a projection or tenon element, which runs along the quartz glass tube, and for the base to have a mortise or groove in which the projection or tenon engages. This structure assures against possible rotation of the infra-red lamp with respect to the base elements.

It is advantageous for the bases of the lamp unit to be geometrically identical. This avoids any necessity, during assembly of the system, to keep track of two different base types, which could lead to mistakes and/or extra labor costs. Further, it is simpler and less expensive to make one element. Bases of electrically insulating, preferably ceramic, material have proven to be advantageous. A suitable material is steatite, also known as soapstone.

For simplicity of manufacture of the infra-red lamp and for easy assembly of the infra-red lamps onto the bases, it has proven to be advantageous to feed the electrical connections through a common end piece or closure cap.

It is particularly advantageous for the lamp unit to have end pieces which engage over or wrap around the ends of the quartz glass tube on at least two sides, or for the end pieces to be formed with an annular groove, into which the ends of the quartz glass tube can project. Such a lamp unit is especially easy to handle, reliable in operation, and easy-to-mount.

In the case of lamps arranged end-to-end, in order to minimize the length of any unheated zone, it has proven advantageous for the wall thickness at the end faces of the quartz glass tubes to be not more than 5 mm or 10 mm, and for the heating coil to end no more than 10 mm or 15 mm from each end of the quartz glass tube.

In view of the objectives of as even as possible a temperature distribution across a large irradiation surface, and as high as possible an irradiation intensity, it is desirable for the quartz glass tube to be a twin tube with two parallel-running but connected quartz glass tubes.

For secure retention of the infra-red lamp on the associated base, under varied operating conditions, it has proven advantageous to have a U-shaped spring which engages around the quartz glass tube, has two free ends in the shape of hooks, and for the base to have grooves into which these hooks engage. The preferred shape of the spring includes a loop which engages in the depression between the two twin tubes. This loop projects in the same direction as the spring ends.

In order to simplify the assembly of the lamp unit, it is advantageous for the fastening elements to be self-tapping screws, and for the assembly apertures to have a diameter slightly smaller than the thread diameter of the screws. The self-tapping screw can be driven into the assembly apertures of the assembly plate from above, i.e. from the same side as the infra-red lamps. They can be removed the same way. Since all the assembly apertures have the same diameter, it is not necessary, when mounting the bases onto the plate, to be concerned about matching the diameters properly.

DRAWINGS

DETAILED DESCRIPTION

Figure 1:
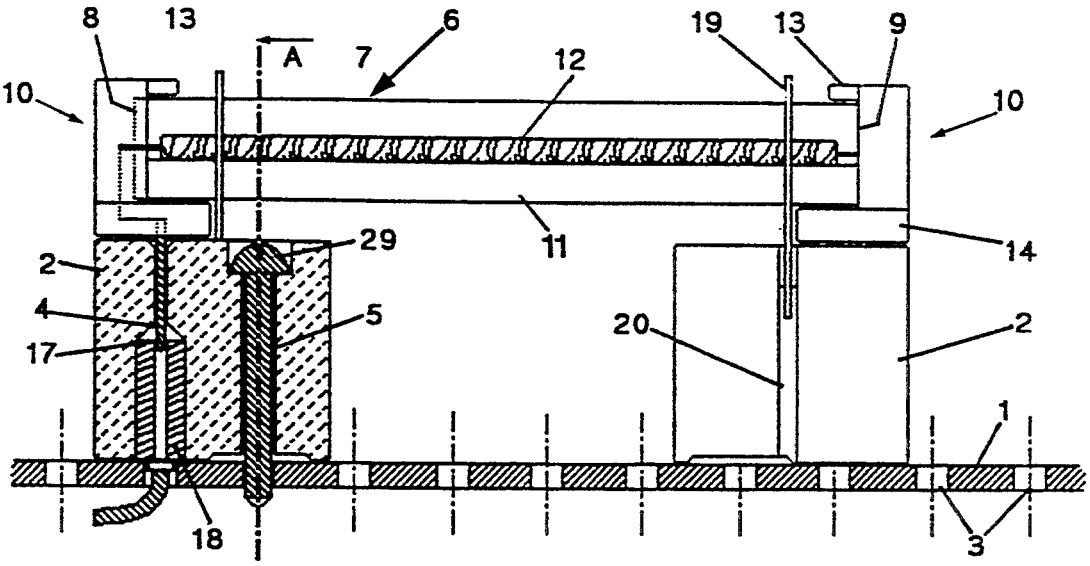
FIG. 1 is a schematic side view of the lamp unit of the present invention, with two bases and an assembly plate shown in section.

In FIG. 1, numeral 1 designates an assembly plate, formed as an apertured plate, on which two ceramic bases 2 are fastened. The apertures 3 formed in the assembly plate 1 are arranged in a continuously repeating quadratic raster pattern. Apertures 3 all have the same internal diameter of about 5 mm and are at intervals of 15.625 mm. Each of the two bases 2 is formed with respective four through-bores 4,5 running normal to the plane of the assembly plate. Two bores 5 serve for fastening of the base 2 onto the assembly plate, while two other bores 4 are part of electrical terminals for connection of an infrared lamp 6, mounted on the bases 2, to a standard power supply (not shown). Through-bores 4 and 5 are also arranged in a quadratic pattern at an interval of 15.625 mm.

Each infrared lamp 6 is preferably a medium-wave lamp having a quartz glass so-called "twin-tube" 7 with open ends 8,9 which are closed by respective surrounding ceramic closure plates or caps 10. On the side of quartz glass tube 7 adjacent base 2, the tube has an outer gold coating 11, which serves as a reflector for rays radiating from a hot coil 12 inside tube 7. The ends 8, 9 of quartz glass tube 7 each extend into a respective annular groove in an end cap 10 (as indicated by dotted line in FIG. 1) and further support is provided by two retaining elements 13, 14 which grip around quartz glass tube 7.

As indicated in FIG. 1, the upper, base-adjacent element 13 is formed as a pin which engages between the two tubes of the twin quartz glass tube 7, while the lower, base-remote element 14 is formed as a flange or projection which extends over the entire breadth of the twin glass tube 7, and which is adhered to tube 7, preferably using an inorganic adhesive.

The lower element 14 of closure plate 10 has, on its base-adjacent side, a protruding rib 15 which extends along the longitudinal axis of quartz glass tube 7 and engages in a corresponding groove 16 (see FIG. 3) of base 2, thereby preventing backwards mounting of infrared lamp 6 onto base 2.

The electrical connections to heating coil 12 are accomplished using two contact pins 17, which project out of closure plate 10, and engage corresponding grooves (not shown). The free ends of contact pins 17 are thus aligned perpendicular to the longitudinal axis of quartz glass tube 7, and are set back from the tube end by a short distance, in the direction of the opposing tube end. The contact pins 17 extend into the contact apertures 4 of base 2, and establish there the electrical contact, with metal sleeves 18 in apertures 4, for power supply to the heating coil 12.

Bases 2 themselves are anchored on assembly plate 1 by means of two self-tapping screws 29 which are accessible from the side of the bases facing the infra-red lamp 6.

Figure 2:
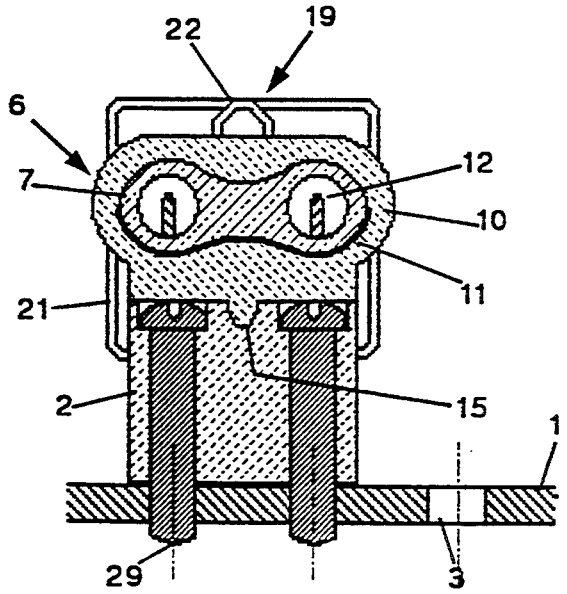
FIG. 2 is a schematic sectional view along line A of FIG. 1, looking in the direction of the longitudinal axis of the quartz glass tube.
Figure 3:
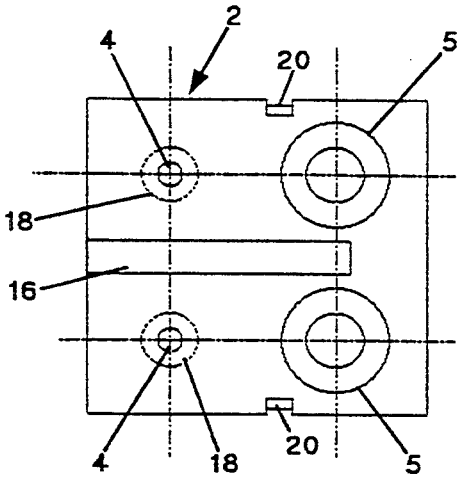
FIG. 3 is a schematic top view of the base of a lamp unit in accordance with the invention.
Figure 4:
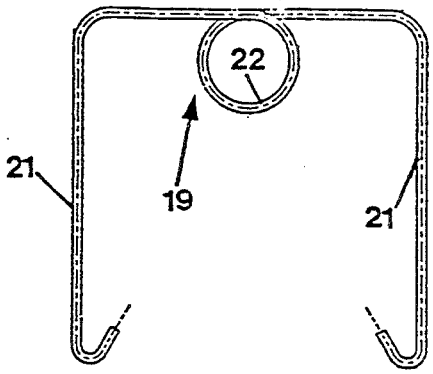
FIG. 4 illustrates a spring used to keep the infrared lamp on the base of the lamp unit.

Infra-red lamp 6 is held onto each base 2 by a respective U-shaped spring 19, as shown in FIG. 4. Each one engages around quartz glass tube 7. Spring 19 has two free legs 21 which are hooked at their ends. These hooks engage in respective grooves 20 on opposing sides of each base 2; see FIG. 3. As shown in FIGS. 2 and 3, each spring 19 is formed with a central, inward-facing loop 22 which projects in the same direction as free legs 21. This loop 22 engages in the slight depression between the twin tubes of quartz glass tube 17. In the longitudinal direction of quartz glass tube 7, each base 2 tightly engages with a respective end of infra-red lamp 6, the end being defined by the closure plate 10.

In the following figures, to the extent that the same reference numerals as in FIG. 1 are used, this designates the same components as in FIG. 1, or their equivalents. As may be seen in the FIG. 2 front view of a lamp unit according to the present invention, base 2 does not project, even in the direction perpendicular to the long axis of quartz glass tube 7, beyond closure plate 10, but rather is formed somewhat narrower than closure plate 10. Base 2 thus does not interfere with the placement, very close together, of a plurality of neighboring, parallel-aligned infra-red lamps.

From the FIG. 3 schematic plan view of a base 2, the arrangement of holes 4, 5 in a quadratic array is apparent. In the middle between contact holes 4 and fastening holes 5, runs with groove 16 into which a rib 15 of lower part 14 of closure plate 10 engages. Reference numerals 20 designate side grooves 20 of bases 2. The hook-shaped free ends 21 of springs 19, which hold the infra-red lamp 6 on bases 2, engage in grooves.

FIG. 4 illustrates a suitable spring 19 for holding infra-red lamp 6 onto base 2. It is generally U-shaped, with a pair of free ends 21 which are bent inward to define hooks. The central portion of spring 19 is formed with the loop 22, which projects in the direction of free ends 21. FIG. 2 shows how loop 22 engages against quartz glass tube of infra-red lamp 6.

Figure 5:
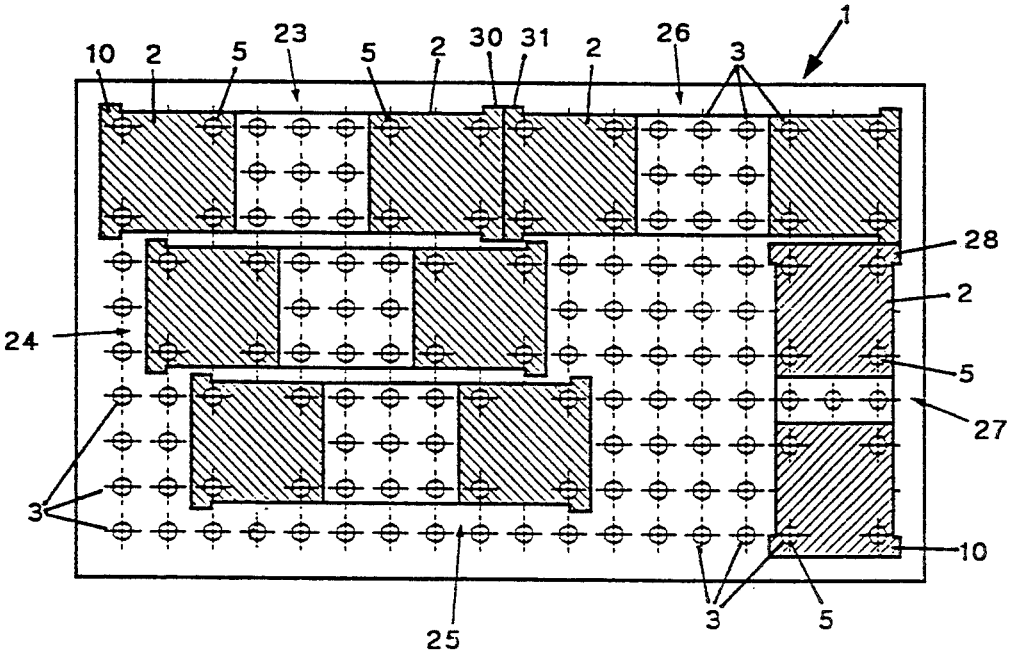
FIG. 5 is a schematic view of a single assembly plate and a plurality of lamp bases, and infrared lamps mounted thereon.

FIG. 5 illustrates an assembly plate 1, formed as a perforated plate with holes 3 arrayed in a quadratic pattern which runs all the way to the edge of assembly plate 1. Mounted thereon are five twin-tube infra-red lamps 23 through 27, each of which is arranged on two geometrically identical bases 2. Each base 2 has four through-holes, including one pair of contact holes 4 and one pair of fastening holes 5. Their spacings correspond to the quadratic pattern of holes 3, but they are twice as far from each other, that is, holes 4 and 5 span three holes 3 in plate 1. The interval between holes 3 of assembly plate 1 specifies the smallest possible displacement of the respective infra-red lamps with respect to each other, as shown by the examples of lamps 23, 24, 25. Given adjacent placement of two infra-red lamps 23, 26 in the form of a straight butt-joint, the length of the unheated zone is specified by the interval between the respective heating coils of the respective infra-red lamps 23, 26.

Since, in this case, the respective adjacent end pieces 30, 31 of infrared lamps 23, 26 are formed with a wall thickness, measured in the direction of the longitudinal axis, of only 4 millimeters, the length of the unheated zone between the infra-red lamps 23 26 can be kept very short. Because of the arrangement of holes 3 in a pattern with four-fold symmetry, it is clearly also possible to rotate infra-red lamps by 90 degrees without having to provide supplemental holes in assembly plate 1.

This is shown by the example of infra-red lamp 27, which has its longitudinal axis turned 90 degrees with respect to the other lamps 23 to 26. Due to the very low-thickness end piece 28, the length of the unheated zone between infra-red lamp 26 and infra-red lamp 27 can be kept relatively short.

The figures clearly show the possibilities for a varying arrangement of the infra-red lamps mounted on bases 2. One should note that during replacement, sidewise movement, or rotation of the infra-red lamps, the respective bases can be simply released at their easily-accessible lamp-adjacent sides, and then newly fastened again.

What is claimed is:

1. An irradiation system having an assembly plate (1) formed with a plurality of receiving elements (3) for selectively fastening bases (2) for mounting thereon at least one infra-red lamp (6), each lamp having a quartz glass tube (7) containing a heating coil (12) and two electrical terminals at respective ends of said tube (7), and first and second ceramic closure caps (10) at respective ends of said tube, each of said caps being associated with one of said bases;

at least one of the two bases (2) supporting each lamp (6) is formed with an electrical passage (4) running perpendicular to the plane of said assembly plate (1), electrical leads to said lamp terminals being fed, in an insulated manner, through said electrical passage (4) and the closure cap associated with said at least one base (2);

wherein, in accordance with the invention, said receiving elements (3) are a plurality of assembly apertures (3) formed in said assembly plate and arranged in a raster pattern having at least three-fold symmetry;

said bases (2) are formed with at least one fastening hole (5), running perpendicular to the plane of said assembly plate, for receiving a fastening element (29) which engages in one of said assembly apertures (3);

the bases (2) formed with said electrical passage (4) and with said fastening hole (5) are so dimensioned that the spacing, between said passage (4) and said fastening hole (5), is compatible with said raster pattern of said assembly apertures (3); said closure caps are releasably mounted on respective ones of said bases (2); and said lamp electrical terminals comprise two contact pins (17) which extend out of one of said closure caps (10) and have free ends at right angles to the longitudinal axis of the quartz glass tube (7) which make electrical contact to a power supply in said electrical passage (4) of said at least one base (2).

2. An irradiation system according to claim 1, wherein said assembly apertures (3) each have the same diameter, and are arranged in a quadratic raster pattern.

3. An irradiation system according to claim 1, wherein the bases (2) are each formed with two fastening holes (5);

the bases (2) are secured to said assembly plate (1) by means of respective fastening elements (29) which pass through respective fastening holes (5) and engage said assembly plate.

4. An irradiation system according to claim 2, wherein at least one base (2) is formed with electrical passages (4) whose spacing, with respect to each other, is compatible with said raster pattern.

5. An irradiation system according to claim 1, wherein the bases (2), on which said closure caps (10) of said lamp (6) are mounted, extend no farther outward, in the direction of the longitudinal axis of said lamp (6), than do said bases, thereby permitting closely adjacent mounting of a plurality of lamps (6) on said assembly plate (1), and said contact pins (17) enter said electrical passages (4) of said at least one base (2) at a longitudinal position, with respect to said quartz glass tube (7) of said lamp (6), which is set back from the ends (8,9) of said tube (7).

6. An irradiation system according to claim 1, wherein each of said bases (2) is formed with a quadratic array of four holes (4; 5) of which two adjacent holes serve as said electrical passages (4) and of which two other adjacent holes serve as said fastening holes (5).

7. An irradiation system according to claim 1, wherein said closure caps (10) have, on a side of said quartz glass tube (7) adjacent said contact pins (17), a wrap-around portion (14) formed with a projection or tenon (15) running longitudinally along said quartz glass tube (7), and each base (2) is formed with a longitudinally extending groove or mortise (16), into which said tenon (15) engages.

8. An irradiation system according to claim 1, wherein each base (2) is identical to each other base (2).

9. An irradiation system according to claim 1, wherein said bases comprise electrically insulating material.

10. An irradiation system according to claim 9, wherein said bases comprise ceramic material.

11. An irradiation system according to claim 1, wherein said contact pins (17) both extend through the same cap (10).

12. An irradiation system according to claim 1, wherein each closure cap (10) is so dimensioned that portions thereof extend longitudinally along said quartz glass tube (7) from an end thereof (8,9) on at least two sides, thereby holding said tube (7) securely in a predefined alignment.

13. An irradiation system according to claim 1, wherein a wall thickness dimension of each closure cap (10), measured along the direction of the longitudinal axis of said tube (7), does not exceed 10 mm.

14. An irradiation system according to claim 1, wherein a wall thickness dimension of each closure cap (10), measured along the direction of the longitudinal axis of said tube (7), does not exceed 5 mm.

15. An irradiation system according to claim 1, wherein the heating coil (12), measured along the direction of the longitudinal axis of said quartz glass tube (7), ends no more than 15 mm from each end (8,9) of said lamp (6).

16. An irradiation system according to claim 1, wherein the heating coil (12), measured along the direction of the longitudinal axis of said quartz glass tube (7), ends no more than 10 mm from each end (8,9) of said lamp (6).

17. An irradiation system according to claim 1, wherein each base (2) is formed with a pair of recesses (20) on opposing sides thereof, and a U-shaped spring (19) engages around said quartz glass tube (7) and has hook-shaped free ends (21) which engage in said recesses (20) of said base (2).

18. An irradiation system according to claim 1, wherein said fastening elements (29) are self-tapping screws, and said assembly apertures (3) each have a diameter slightly smaller than a thread diameter of said self-tapping screws (29).

* * * * *